US008834183B2

(12) United States Patent
Komoto et al.

(10) Patent No.: US 8,834,183 B2
(45) Date of Patent: Sep. 16, 2014

(54) HOUSINGLESS CONNECTOR

(71) Applicant: Japan Aviation Electronics Industry, Ltd., Tokyo (JP)

(72) Inventors: Tetsuya Komoto, Tokyo (JP); Yu Tatebe, Tokyo (JP); Takuya Yakahashi, Tokyo (JP); Ryuzo Shimeno, Tokyo (JP)

(73) Assignee: Japan Aviation Eletronics Industry, Ltd., Tokyo (JP)

( * ) Notice: Subject to any disclaimer, the term of this patent is extended or adjusted under 35 U.S.C. 154(b) by 23 days.

(21) Appl. No.: 13/896,036

(22) Filed: May 16, 2013

(65) Prior Publication Data

US 2014/0004745 A1 Jan. 2, 2014

(30) Foreign Application Priority Data

Jun. 28, 2012 (JP) ..... 2012-145618

(51) Int. Cl.

| | |
|---|---|
| ***H01R 12/79*** | (2011.01) |
| ***H01R 12/78*** | (2011.01) |
| ***H01R 12/71*** | (2011.01) |
| *H01R 12/00* | (2006.01) |
| *H01R 24/00* | (2011.01) |
| *H01R 13/46* | (2006.01) |
| *H01R 12/73* | (2011.01) |

(52) U.S. Cl.

CPC ..... *H01R 12/71* (2013.01); *H01R 12/73* (2013.01); *H01R 12/718* (2013.01); *Y10S 439/931* (2013.01)

USPC ..... 439/74; 439/626; 439/65; 439/66; 439/62; 439/507; 439/513; 439/931; 439/884

(58) Field of Classification Search

USPC ..... 439/74, 66, 626

See application file for complete search history.

(56) References Cited

U.S. PATENT DOCUMENTS

| | | | | |
|---|---|---|---|---|
| 7,153,164 | B2 * | 12/2006 | Farnworth et al. | 439/630 |
| 8,540,534 | B2 * | 9/2013 | Sato et al. | 439/660 |
| 2010/0159717 | A1 * | 6/2010 | Takeuchi | 439/65 |
| 2013/0065460 | A1 * | 3/2013 | Hirata | 439/884 |
| 2013/0072037 | A1 * | 3/2013 | Takahashi et al. | 439/62 |
| 2013/0137305 | A1 * | 5/2013 | Komoto et al. | 439/626 |

FOREIGN PATENT DOCUMENTS

| | | | |
|---|---|---|---|
| JP | 2006-228612 | A | 8/2006 |
| JP | 2011253725 | A * | 12/2011 |

* cited by examiner

*Primary Examiner* — Eva Y Montalvo
*Assistant Examiner* — Matthew T Dzierzynski
(74) *Attorney, Agent, or Firm* — Maier & Maier, PLLC

(57) ABSTRACT

A board-to-board connector includes a receptacle connector and a plug connector. The receptacle connector includes a plurality of beam parts having a metal plate and an insulating layer formed on the metal plate and a plurality of conductive patterns formed on the insulating layer of the plurality of beam parts. The plug connector includes a beam contact part having a metal plate and an insulating layer formed on the metal plate and a plurality of conductive patterns formed on the insulating layer of the beam contact part. A beam projection is formed between the adjacent conductive patterns of the plug connector, and the beam projection is inserted between the adjacent beam parts of the receptacle connector when the receptacle connector and the plug connector are mated.

8 Claims, 13 Drawing Sheets

RELATED ART

HOUSINGLESS CONNECTOR

RELATED APPLICATIONS

This application claims priority under 35 U.S.C. §119 to Japanese Patent Application No 2012445618, filed on Jun. 28, 2012, the disclosure of which is incorporated by reference herein in its entirety.

BACKGROUND OF THE INVENTION

1. Field of the Invention

The present invention relates to a housingless connector.

2. Description of Related Art

As this kind of technique, Japanese Unexamined Patent Application Publication No. 2006-228612 discloses a connector 105 that includes a base material 101 with a plurality of openings 100 formed in a predetermined pitch direction, an insulating layer 102 disposed on the base material 101, a contact part 103 formed on the insulating layer 102 and between the openings 100, and a conductor part 104 disposed on the contact part 103. The contact part 103 is formed in a substantially U-shape, and the conductor part 104 is a contact part to be in contact with a mating connector.

SUMMARY OF THE INVENTION

Japanese Unexamined Patent Application Publication No. 2006-228612 has an unsolved problem regarding positioning in the pitch direction between the connector 105 and the mating connector.

An object of the present invention is to provide a technique for assuring normal contacts between conductive patterns in a housingless connector.

A first exemplary aspect of the present invention is a housingless connector that includes a first housingless connector part including a plurality of beam parts and a plurality of first conductive patterns, the plurality of beam parts having a first metal plate and a first insulating layer formed on the first metal plate, and the plurality of first conductive patterns being formed on the first insulating layer of the plurality of beam parts; and a second housingless connector part including a beam contact part and a plurality of second conductive patterns, the beam contact part having a second metal plate and a second insulating layer formed on the second metal plate, and the plurality of second conductive patterns being formed on the second insulating layer of the beam contact part, wherein when the first housingless connector part and the second housingless connector part are mated, the plurality of first conductive patterns and the plurality of second conductive patterns are electrically and respectively brought into contact, and a beam projection is formed between the adjacent second conductive patterns of the second housingless connector part, and the beam projection is inserted between the adjacent beam parts of the first housingless connector part when the first housingless connector part and the second housingless connector part are mated.

Preferably, the plurality of beam parts are formed in cantilevers.

A second exemplary aspect of the present invention is a housingless connector that includes a first housingless connector part including a surface part and a plurality of first conductive patterns, the surface part having a first metal plate and a first insulating layer formed on the first metal plate, and the plurality of first conductive patterns being formed on the first insulating layer of the surface part; and a second housingless connector part including a surface contact part and a plurality of second conductive patterns, the surface contact part having a second metal plate and a second insulating layer formed on the second metal plate, and the plurality of second conductive patterns being formed on the second insulating layer of the surface contact part, wherein when the first housingless connector part and the second housingless connector part are mated, the plurality of first conductive patterns and the plurality of second conductive patterns are electrically and respectively brought into contact, and a surface projection is formed between the adjacent second conductive patterns of the second housingless connector part, and the surface projection is inserted between the adjacent first conductive patterns of the first housingless connector part when the first housingless connector part and the second housingless connector part are mated.

Preferably, a surface recess is formed where the first metal plate is directly exposed as the first insulating layer is not present between the adjacent first conductive patterns of the first housingless connector part, and the surface projection is inserted into the surface recess when the first housingless connector part and the second housingless connector part are mated.

Preferably, a tip part in a mating direction of the beam projection or the surface projection is formed in a tapered shape.

Preferably, the beam projection or the surface projection is formed of an insulator.

The present invention enables the plurality of first conductive patterns to be electrically and properly connected to the plurality of second conductive patterns.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Hereinafter, a first exemplary embodiment of the present invention is explained with reference to FIGS. 1 to 12. In each drawing, fine hatching applied on the surface except the cross-section surface is an image of conductive patterns.

(Board-to-Board Connector 1)

Figure 1:
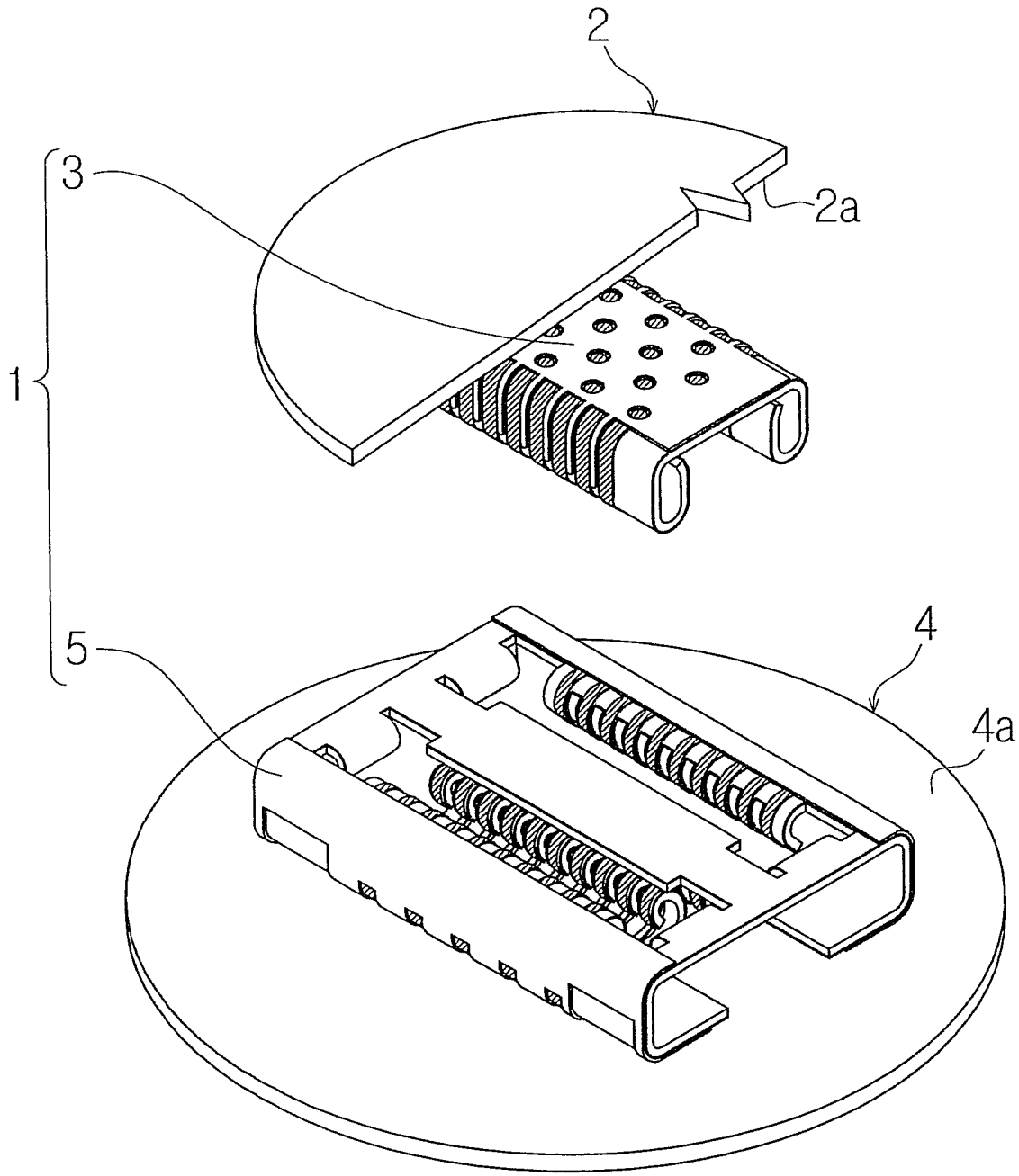
FIG. 1 is an exploded perspective view of a board-to-board connector.

As shown in FIG. 1, a board-to-board connector 1 (housingless connector) is composed of a plug connector 3 (second housingless connector part) to be mounted on a connector mounting surface 2*a* of a plug substrate 2 (second substrate) and a receptacle connector 5 (first housingless connector part) to be mounted on a connector mounting surface 4*a* of a receptacle substrate 4 (first substrate). The plug substrate 2 and the receptacle substrate 4 are electrically connected by mating the plug connector 3 to the receptacle connector 5. In this exemplary embodiment, both of the plug connector 3 and the receptacle connector 5 include an insulating layer on a metal plate and a plurality of conductive patterns formed on the insulating layer, and do not include a resin housing.

(Receptacle Connector 5)

Next, the receptacle connector 5 is explained with reference to FIGS. 2 to 5.

As shown in FIGS. 2 to 5, the receptacle connector 5 is composed of an insulating layered metal plate 6, which is a metal plate M1 (first metal plate) including an insulating layer I1 (first insulating layer) formed on one side, a plurality of conductive patterns 7 (first conductive patterns), and a pair of insulating sheets 8.

Figure 2:
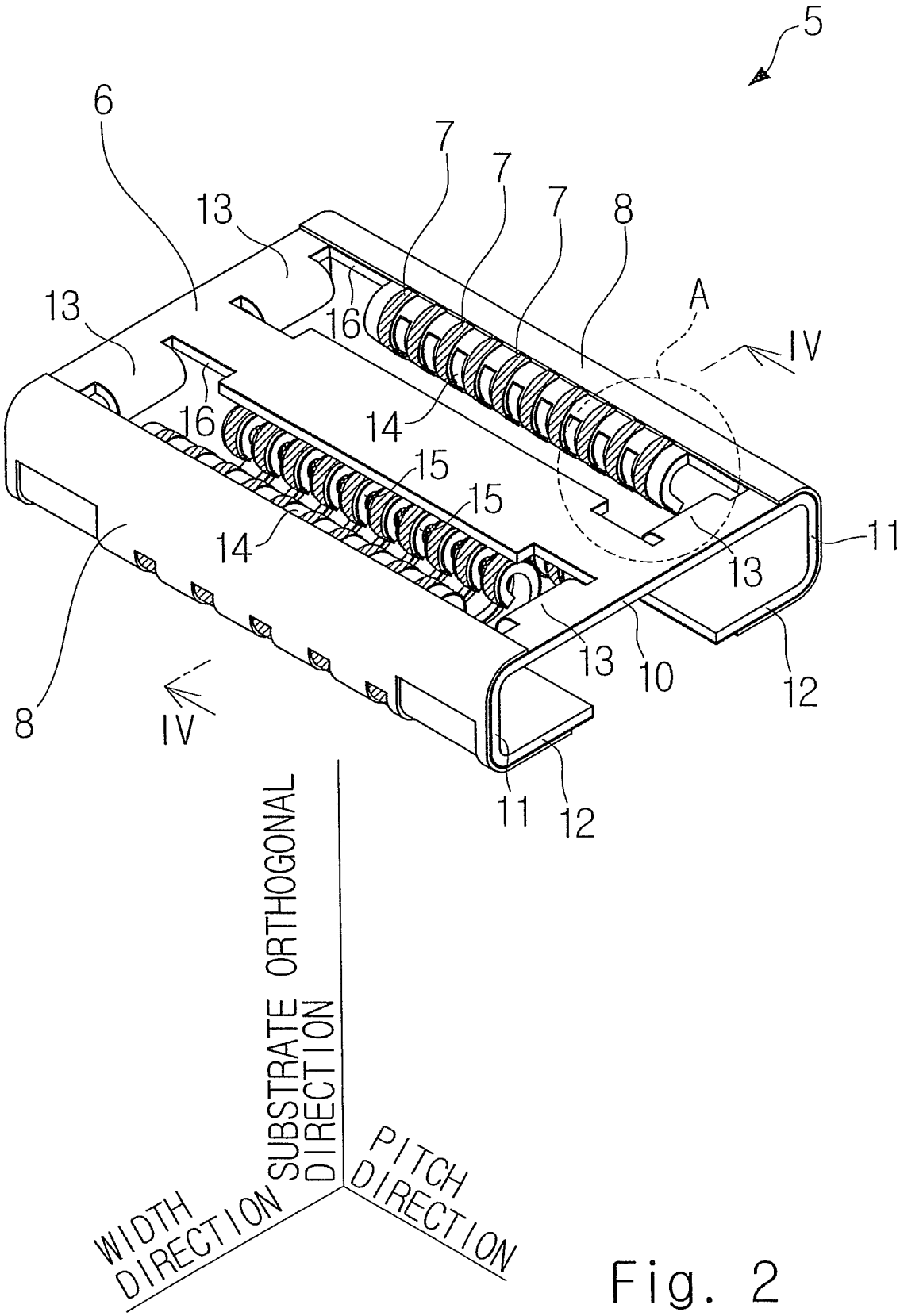
FIG. 2 is a perspective view of a receptacle connector.

As shown in FIG. 2, the insulating layered metal plate 6 is formed in a substantially square tube shape. More specifically, the insulating layered metal plate 6 is formed into a plate first and bent in a way so that the insulating layer formed on one side will be an outer circumference side to be a substantially square tube shape. The insulating layered metal plate 6 is composed of a top plate 10, a pair of side plates 11, a pair of bottom plates 12 (beam part supporting parts), four mating guide parts 13, a pair of surface parts 14, and a plurality of beam parts 15.

The top plate 10 is a rectangular plate. Two mating holes 16 are formed in the top plate 10. The two mating holes 16 are elongated in a longitudinal direction of the top plate 10. The two mating holes 16 are arranged in a short side direction of the top plate 10.

Explained below are definitions of a "pitch direction", a "width direction", and a "substrate orthogonal direction". The pitch direction is a longitudinal direction of the top plate 10. Within the pitch direction, a direction approaching to the center of the receptacle connector 5 is defined as a pitch center direction, and a direction away from the center of the receptacle connector 5 is defined as a pitch non-center direction. The width direction is the short side direction of the top plate 10. Within the width direction, a direction approaching to the center of the receptacle connector 5 is defined as a width center direction, and a direction away from the center of the receptacle connector 5 is defined as a width non-center direction. The substrate orthogonal direction is a direction orthogonal to the top plate 10. Within the substrate orthogonal direction, a direction approaching to the connector mounting surface 4*a* of the receptacle substrate 4 is defined as a substrate approaching direction, and a direction away from the connector mounting surface 4*a* of the receptacle substrate 4 is defined as a substrate away direction. The pitch direction, the width direction, and the substrate orthogonal direction are orthogonal to one another.

The pair of side plates 11 is rectangular plates that extend from an end part on the width non-center direction of the top plate 10 toward the substrate approaching direction. The pair of side plates 11 is orthogonal to the width direction.

The pair of bottom plates 12 is rectangular plates that extend from an end part on the substrate approaching direction side of the pair of side plates 11 toward the width center direction. The pair of bottom plates 12 is orthogonal to the substrate orthogonal direction.

The four mating guide parts 13 are formed inside the two mating holes 16. Two of the four mating guide parts 13 are formed inside one mating hole 16, and the remaining two mating guide parts 13 are formed inside the other mating hole 16. Each mating guide part 13 is elongated from an edge on the pitch non-center direction side of the mating hole 16. Each mating guide part 13 is bent to protrude in the pitch center direction.

The two surface parts 14 are formed inside the two mating holes 16. One of the two surface parts 14 is formed inside one mating hole 16, and the other surface part 14 is formed inside the other mating hole 16. Each surface part 14 is formed extending from an edge on the width non-center direction side of the mating hole 16 toward the substrate approaching direction. Each surface part 14 is bent to protrude in the width center direction (see FIGS. 4 and 5).

Figure 4:
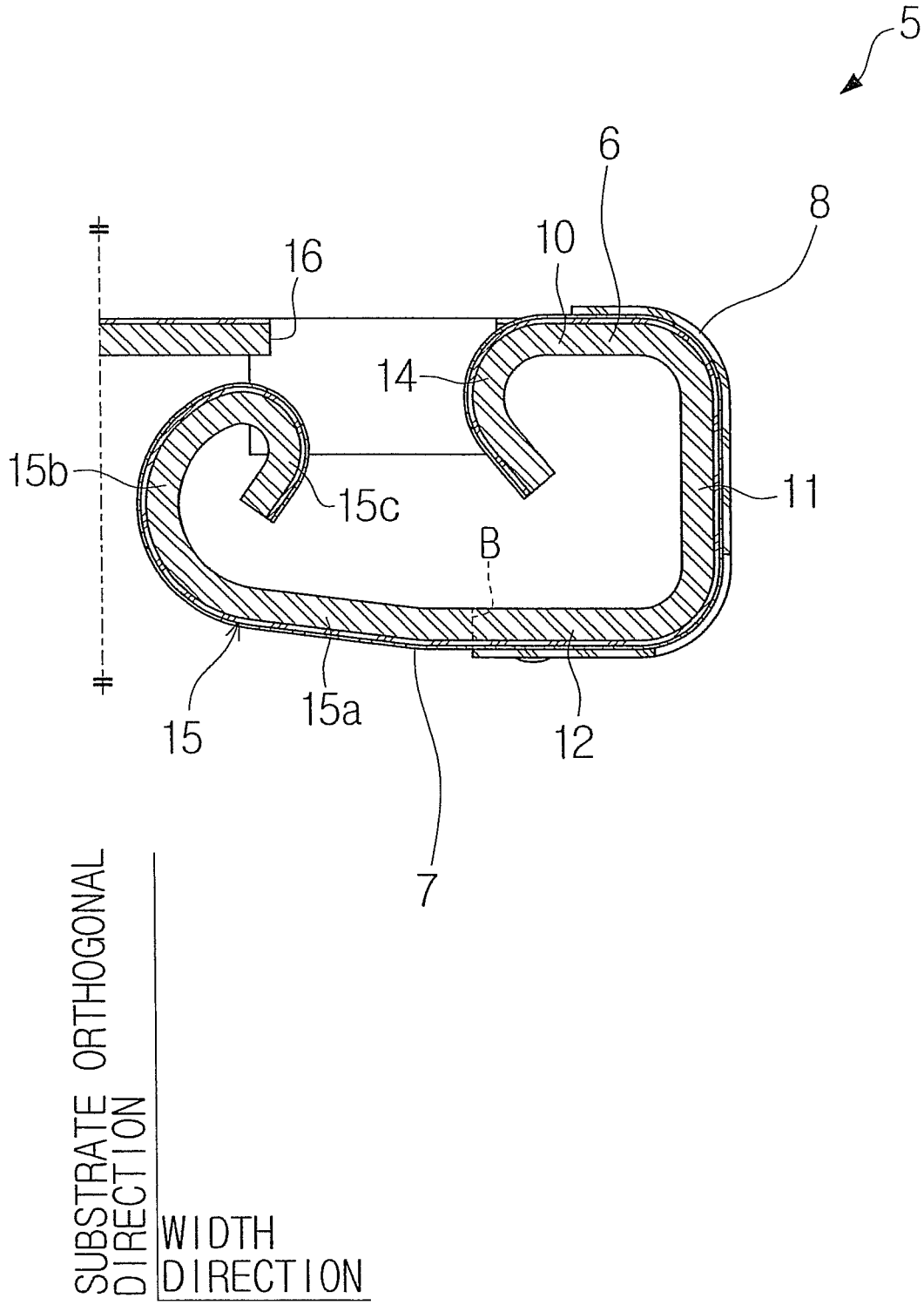
FIG. 4 is a cross-sectional view taken along the line IV-IV of FIG. 2.

The plurality of beam parts 15 are formed between the pair of side plates 11. Half of the beam parts 15 are supported by one bottom plate 12, and the remaining half beam parts 15 are supported by the other bottom plate 12. The beam parts 15 are cantilevered in parallel to the width direction. The beam parts 15 are arranged in the pitch direction with a predetermined interval therebetween. The beam parts 15 are parallel to one another. As shown in FIG. 4, each beam part 15 is elongated from an end part on the width center direction side of the bottom plate 12. A boundary line B between the beam part 15 and the bottom plate 12 is indicated by the dashed line in FIG. 4. Each beam part 15 has a horizontal part 15*a*, a first curved part 15*b*, and a second curved part 15*c*. The horizontal part 15*a* is a part extending substantially horizontally from the end part on the width center direction side of the bottom plate 12 toward the width center direction. The first curved part 15*b* is a part extending from an end part on the width center direction side of the horizontal part 15*a* in the substrate away direction. The first curved part 15*b* is bent to protrude in the width center direction. The second curved part 15*c* is a part extending from an end part on the substrate away direction side of the first curved part 15*b* toward the substrate approaching direction. The second curved part 15*c* is bent to protrude in the width non-center direction.

The conductive patterns 7 are formed on the insulating layer of the insulating layered metal plate 6. The conductive patterns 7 are formed on an outer circumference side of the insulating layered metal plate 6. Each conductive pattern 7 is formed into an elongated tape. The conductive patterns 7 are arranged in the pitch direction with a predetermined interval therebetween. The conductive patterns 7 are parallel to one another. As shown in FIG. 4, each conductive pattern 7 is formed to cover the surface part 14, the top plate 10, the side plate 11, the bottom plate 12, and the beam part 15 in order. Therefore, the conductive pattern 7 on the surface part 14 and the conductive pattern 7 on the beam part 15 are both a part of one conductive pattern 7.

Figure 5:
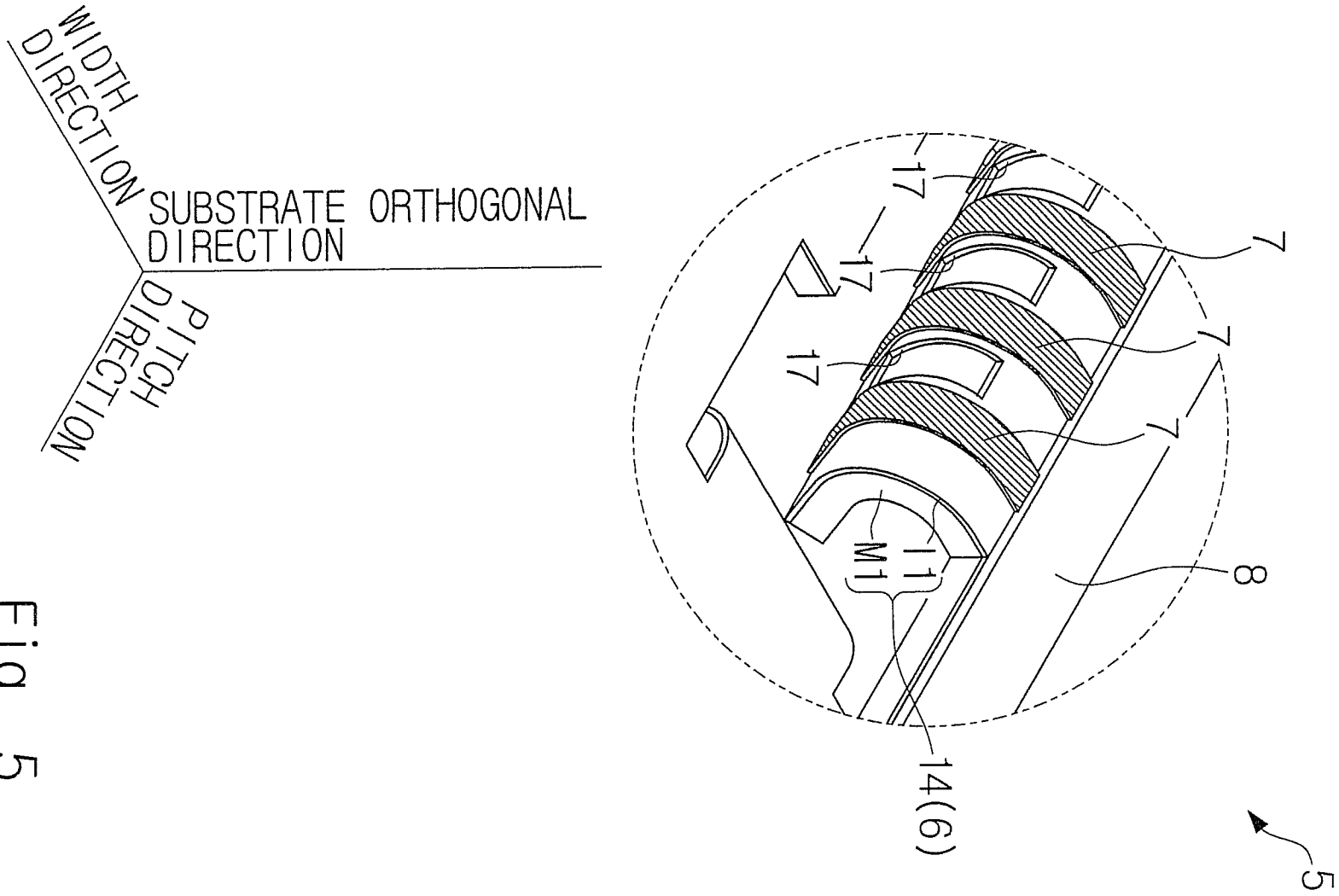
FIG. 5 is a diagram showing an enlarged A part of FIG. 2.

As shown in FIG. 5, the insulating layered metal plate 6 is composed of the insulating layer I1 formed on the metal plate M1. In this exemplary embodiment, the insulating layer I1 is partially removed and not partially present between the conductive patterns 7 that are adjacent in the pitch direction on the surface part 14, and surface recesses 17 are formed where the metal plate M1 is exposed directly on the width center direction side. The surface recess 17 may be formed in the following manner. After the insulating layer I1 is formed evenly on the metal plate M1, the insulating layer I1 may be partially removed. Alternatively, a part of the metal plate M1 may be masked and the insulating layer I1 may be formed thereon.

Figure 3:
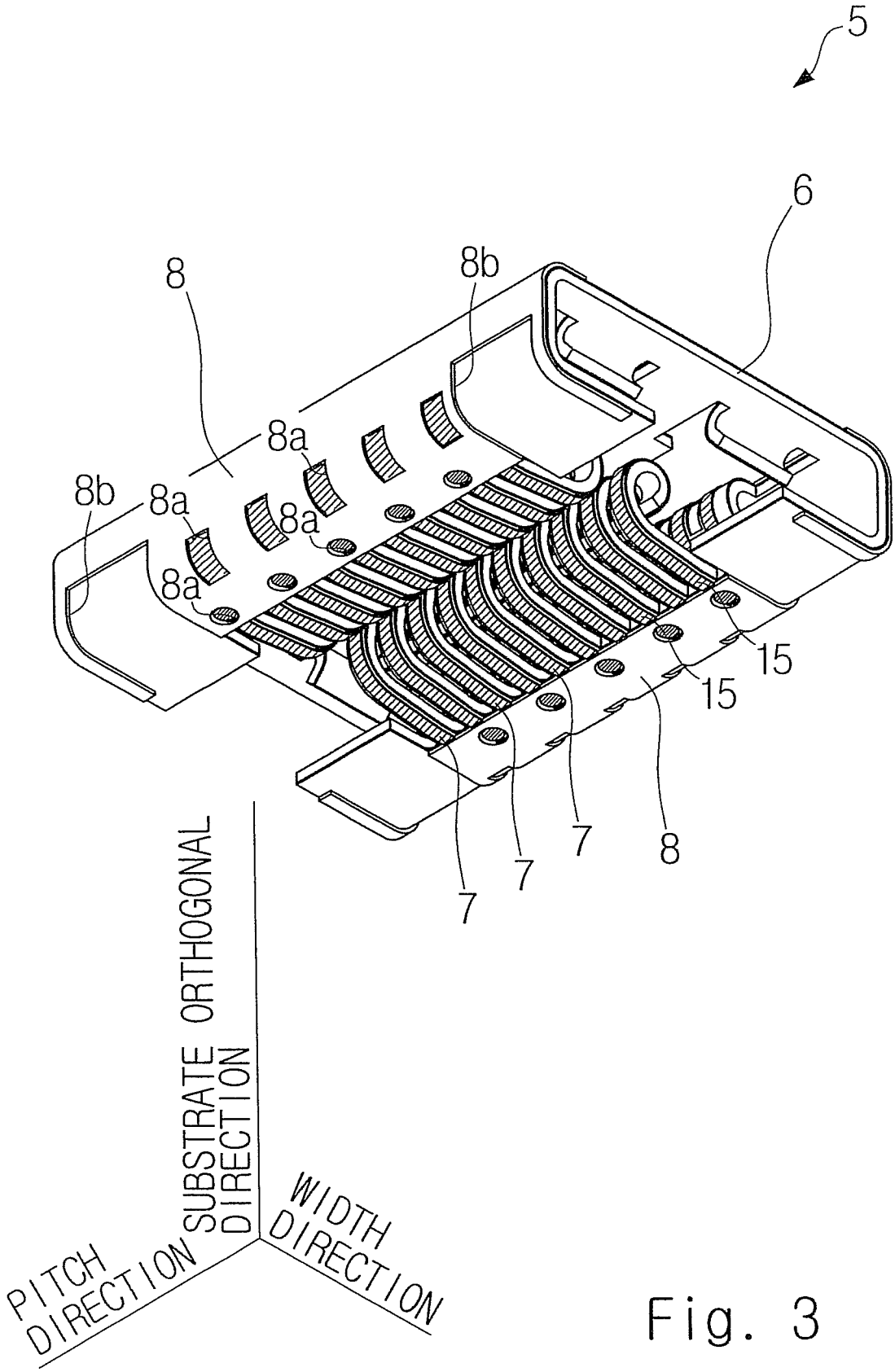
FIG. 3 is a perspective view of the receptacle connector from another angle.

As shown in FIG. 2, each insulating sheet 8 is formed to cover the top plate 10, the side plate 11, and the bottom plate 12. The insulating sheet 8 prevents electrical contacts between the conductive patterns 7 that are exposed outside and other electronic components adjacent to the board-to-board connector 1. As shown in FIG. 3, a plurality of solder windows 8*a* and a pair of hold-down windows 8*b* are formed in each insulating sheet 8. Each solder window 8*a* is a window for soldering the conductive pattern 7 to a signal electrode pad not shown that is formed on the connector mounting surface 4*a* of the receptacle substrate 4. The hold-down window 8*b* is a window for soldering the receptacle connector 5 to a hold-down pad not shown that is formed on the connector mounting surface 4*a* of the receptacle substrate 4.

(Plug Connector 3)

Next, the plug connector 3 is explained with reference to FIGS. 6 to 10. Note that the directions defined with reference to FIG. 2 shall be used also in the explanation of the plug connector 3. However, the "substrate approaching direction" and the "substrate away direction" that are defined using the connector mounting surface 4*a* of the receptacle substrate 4 are used here as well, thus please keep the following point in mind when the substrate orthogonal direction is mentioned. Specially, as the "substrate approaching direction" and the "substrate away direction" are defined based on the connector mounting surface 4*a* of the receptacle substrate 4, the "substrate approaching direction" is a direction away from the connector mounting surface 2*a* of the plug substrate 2, and the "substrate away direction" is a direction approaching toward the connector mounting surface 2*a* of the plug substrate 2.

Figure 6:
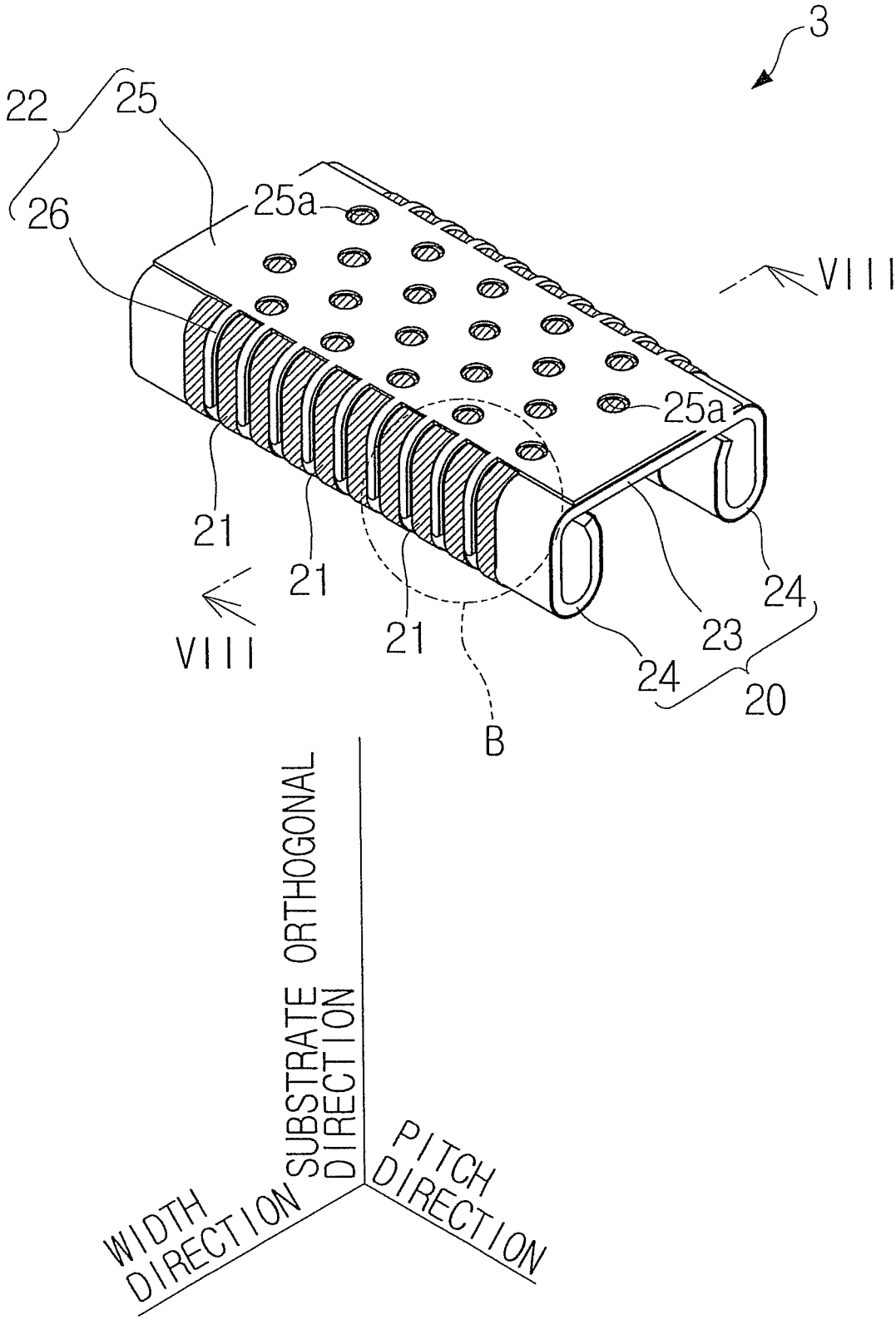
FIG. 6 is a perspective view of a plug connector.
Figure 7:
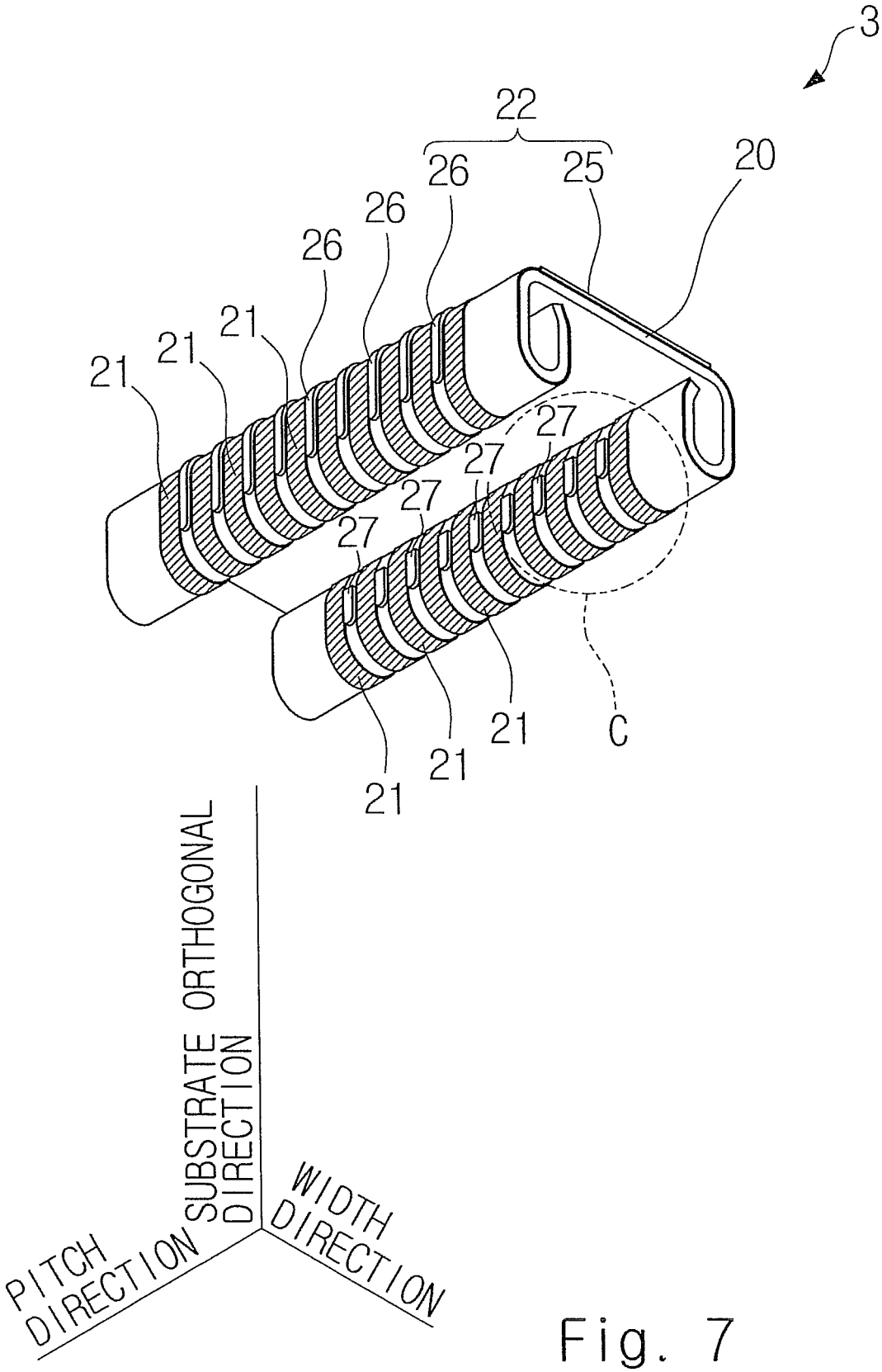
FIG. 7 is a perspective view of the plug connector from another angle.
Figure 8:
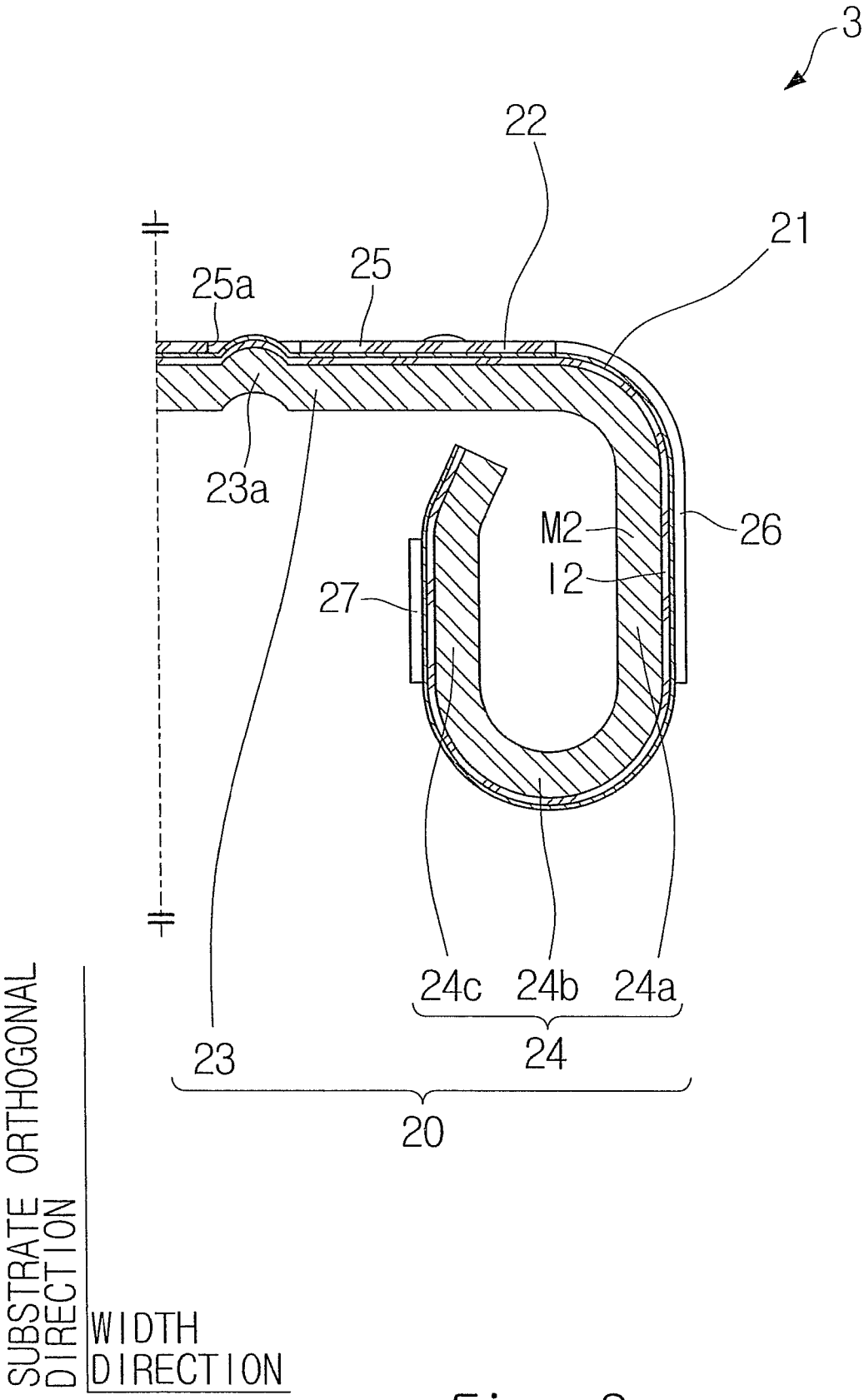
FIG. 8 is a cross-sectional view taken along the line VIII-VIII of FIG. 6.

As shown in FIGS. 6 to 8, the plug connector 3 is composed of an insulating layered metal plate 20, which is a metal plate M2 (second metal plate) including an insulating layer I2 (second insulating layer) formed on one side, a plurality of conductive patterns 21, and an insulating sheet 22.

As shown in FIG. 6, the insulating layered metal plate 20 is composed of a bottom plate 23 and a pair of U-shaped parts 24. The insulating layered metal plate 20 is firstly formed into a plate and bent in a way that the insulating layer I2 formed on one side will be an outer circumference side.

The bottom plate 23 is a rectangular plate. The bottom plate 23 is orthogonal to the substrate orthogonal direction. The longitudinal direction of the bottom plate 23 is parallel to the pitch direction.

As shown in FIG. 8, the U-shaped part 24 is composed of a surface contact part 24*a*, a curved part 24*b*, and a beam contact part 24*c*. The surface contact part 24*a* is a plate part extending from an end part on the width non-center direction side of the bottom plate 23 toward the substrate approaching direction. The surface contact part 24*a* is orthogonal to the width direction. The curved part 24*b* is a part extending from an end part on the substrate approaching direction side of the surface contact part 24*a* toward the width center direction. The curved part 24*b* is bent to protrude in the substrate approaching direction. The beam contact part 24*c* is a plate part extending from an end part on the width center direction side of the curved part 24*b* toward the substrate away direction. The beam contact part 24*c* is orthogonal to the width direction.

The conductive patterns 21 are formed on the insulating layer I2 of the insulating layered metal plate 20. The conductive patterns 21 are formed outside the insulating layered metal plate 20. The conductive patterns 21 are arranged in the pitch direction with a predetermined interval therebetween. The patterns 21 are parallel to one another. Each conductive pattern 21 is formed into an elongated tape. As shown in FIG. 8, each conductive pattern 21 is formed to cover the bottom plate 23 and the U-shaped part 24 (including the surface contact part 24*a*, the curved part 24*b*, and the beam contact part 24*c*). Therefore, the conductive pattern 21 on the surface contact part 24*a* and the conductive pattern 21 on the beam contact part 24*c* are both a part of one conductive pattern 21.

As shown in FIG. 6, the insulating sheet 22 is composed of an insulating sheet body 25 and a plurality of surface projections 26.

The insulating sheet body 25 covers the bottom plate 23. The insulating sheet body 25 prevents electrical contacts between the conductive patterns 21 that are exposed outside and unintended patterns on the connector mounting surface 2*a* of the plug substrate 2. As shown in FIGS. 6 and 8, a plurality of solder windows 25*a* are formed in the insulating sheet body 25. Each solder window 25*a* is a window for soldering the conductive pattern 21 to a signal electrode pad not shown that is formed on the connector mounting surface 2*a* of the plug substrate 2. As shown in FIG. 8, a plurality of protrusions 23*a* that protrude locally toward the substrate away direction are formed on the bottom plate 23. The protrusions 23*a* are formed to correspond to the solder windows 25*a*. By the existence of the protrusions 23*a*, each conductive pattern 21 penetrates the solder windows 25*a* and locally protrudes in the substrate away direction. These protrusions facilitate the abovementioned soldering. Note that the protrusions (protrusions 23*a*) are also formed on the receptacle connector 5 for the similar purpose (see FIG. 3).

Figure 9:
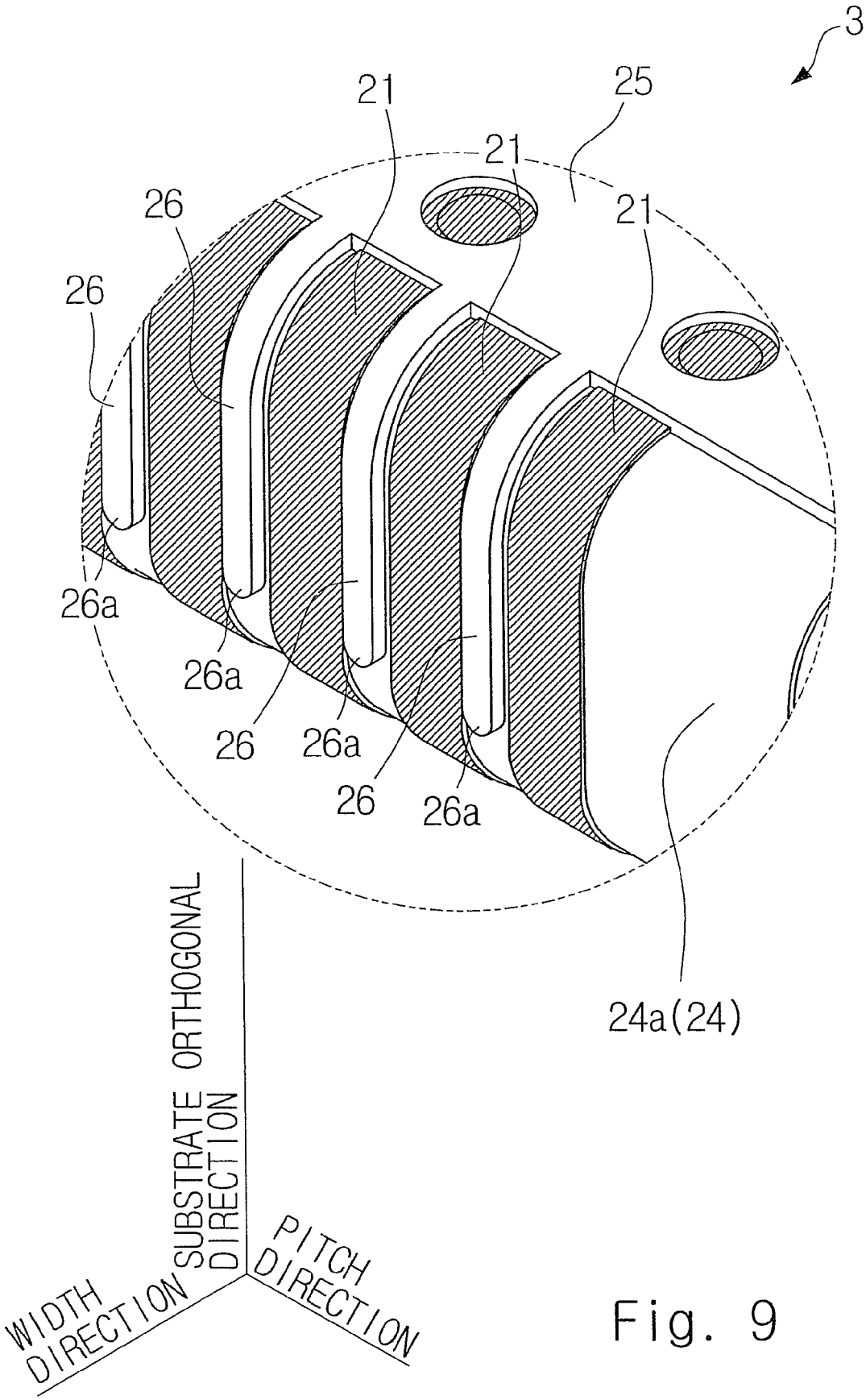
FIG. 9 is a diagram showing an enlarged B part of FIG. 6.

As shown in FIG. 9, the surface projections 26 extend elongate from an end part on the width non-center direction side of the insulating sheet body 25 in the substrate approaching direction. The surface projections 26 are disposed between the conductive patterns 21 that are adjacent in the pitch direction on the surface contact part 24*a*. The surface projections 26 project in the width non-center direction from the conductive patterns 21. A tip part 26*a* on the substrate approaching direction side of the surface projection 26 is formed in a tapered shape. In this exemplary embodiment, the tip part 26*a* on the substrate approaching direction side of the surface projection 26 is formed to be an arc-shape.

Figure 10:
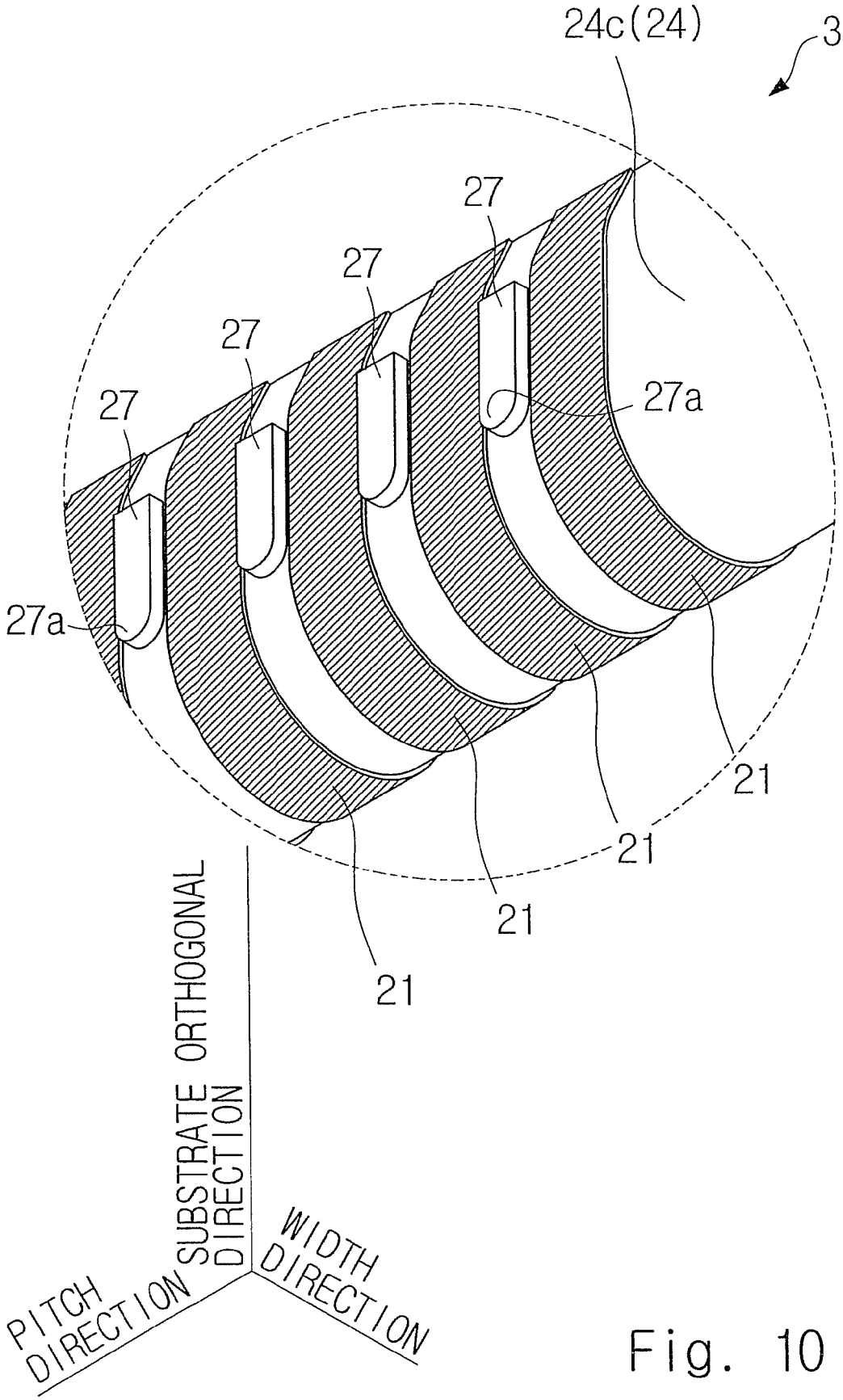
FIG. 10 is a diagram showing an enlarged C part of FIG. 7.

Moreover, as shown in FIG. 10, the beam projections 27 are formed between the conductive patterns 21 that are adjacent in the pitch direction on the beam contact part 24*c*. Each beam projection 27 extends in the substrate orthogonal direction. The beam projections 27 project in the width center direction from the conductive patterns 21. A tip part 27*a* on the substrate approaching direction side of the beam projection 27 is formed in a tapered shape. In this exemplary embodiment, the tip part 27*a* on the substrate approaching direction side of the beam projection 27 is formed to be an arc-shape.

(Material)

In this exemplary embodiment, the metal plate M1 of the receptacle connector 5 and the metal plate M2 of the plug connector 3 are made of SUS, and the thickness thereof is 50 to 80 micrometers. However, copper and copper alloy may be used instead. The insulating layer I1 and the insulating layer I2 are made of polyimide, and the thickness thereof is about 25 to 50 micrometers. Instead, aramid may be used for the material of the insulating layers I1 and I2, and an oxide film of the metal plates M1 and M2 may be used for the insulating layers I1 and I2. Moreover, the conductive patterns 7 and 21 are made of copper foil, and the thickness is about 20 micrometers. Instead, the conductive patterns 7 and 21 may be formed by deposition or plating. Further, the insulating sheets 8 and 22 are made of polyimide, and the thickness thereof is 10 to 30 micrometers. Note that the material for the insulating sheets 8 and 22 may be appropriately selected as long as it is an insulator with environmental resistance characteristics adaptable to bend and usages.

(Mating Action)

Hereinafter, mating of the plug connector 3 and the receptacle connector 5 shown in FIG. 1 is explained. The plug connector 3 shall already be mounted on the connector mounting surface 2*a* of the plug substrate 2, and the receptacle connector 5 shall already be mounted on the connector mounting surface 4*a* of the receptacle substrate 4.

Firstly, in a state where the plug connector 3 and the receptacle connector 5 are placed face-to-face, the plug connector 3 is lowered toward the receptacle connector 5, and the pair of U-shaped parts 24 of the plug connector 3 shown in FIG. 6 are respectively inserted into the pair of mating holes 16 in the top plate 10 of the receptacle connector 5 shown in FIG. 2. At this time, as the pair of U-shaped parts 24 of the plug connector 3 shown in FIG. 6 is brought in contact with the mating guide parts 13 of the receptacle connector 5 shown in FIG. 2, the plug connector 3 is roughly positioned in the pitch direction of the plug connector 3 with the receptacle connector 5.

When the pair of U-shaped parts 24 of the plug connector 3 shown in FIG. 6 is continuously inserted into the respective pair of mating holes 16 in the top plate 10 of the receptacle connector 5 shown in FIG. 2, the U-shaped parts 24 of the plug connector 3 shown in FIG. 8 are inserted between the surface part 14 and the second curved part 15*c* of the beam part 15 composing the receptacle connector 5 shown in FIG. 4 while generating elastic displacement in the width center direction of the second curved part 15*c* of the beam part 15 composing the receptacle connector 5 shown in FIG. 4. Consequently, the surface contact part 24*a* of the U-shaped part 24 composing the plug connector 3 shown in FIG. 8 faces, in the width direction, the surface part 14 of the receptacle connector 5 shown in FIG. 4. Similarly as a result, the beam contact part 24*c* of the U-shaped part 24 composing the plug connector 3 shown in FIG. 8 faces, in the width direction, the second curved part 15*c* of the beam part 15 composing the receptacle connector 5 shown in FIG. 4. Then, each conductive pattern 21 of the plug connector 3 shown in FIG. 8 is brought into contact with the respective conductive pattern 7 of the receptacle connector 5 shown in FIG. 4 at two points, thereby making the conductive patterns 21 and 7 conductive.

Figure 11:
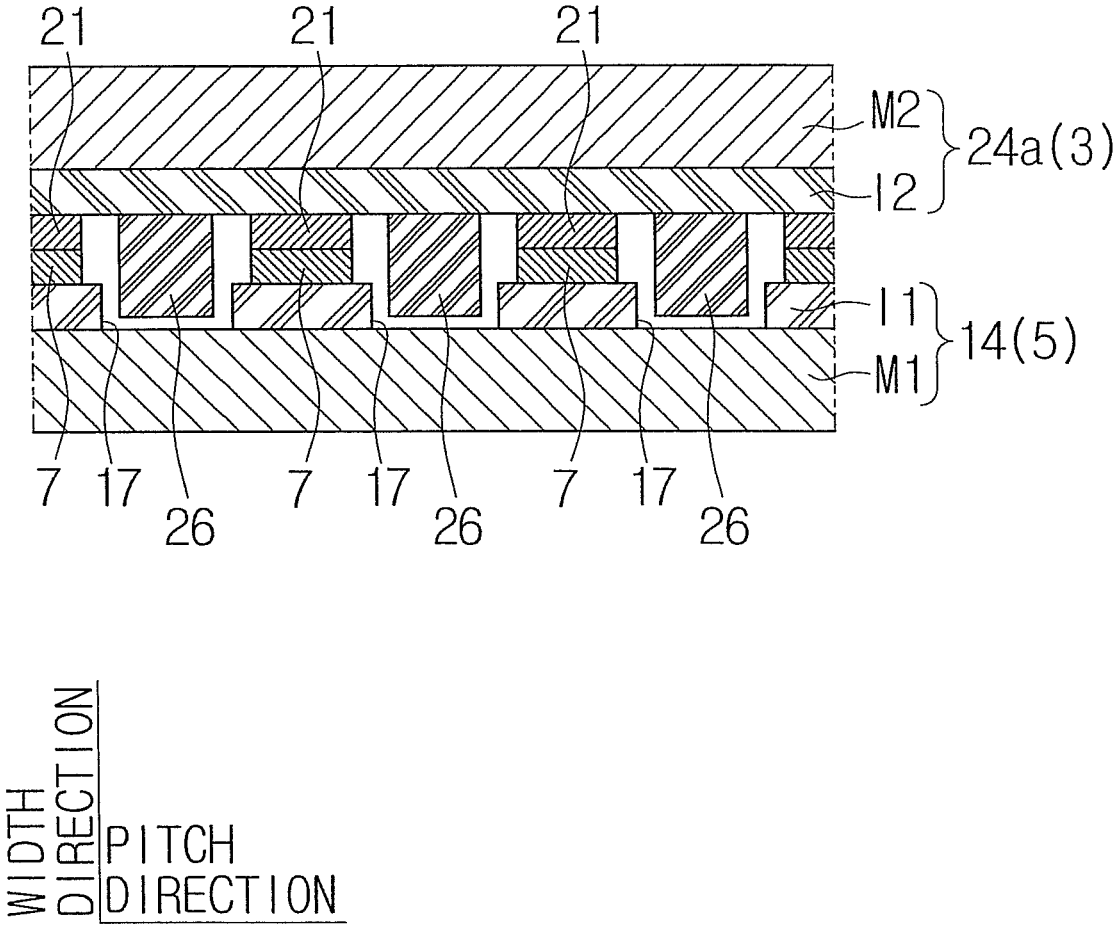
FIG. 11 is a horizontal section showing a contact state between a surface part of the receptacle connector and a surface contact part of a U-shaped part of the plug connector.
Figure 12:
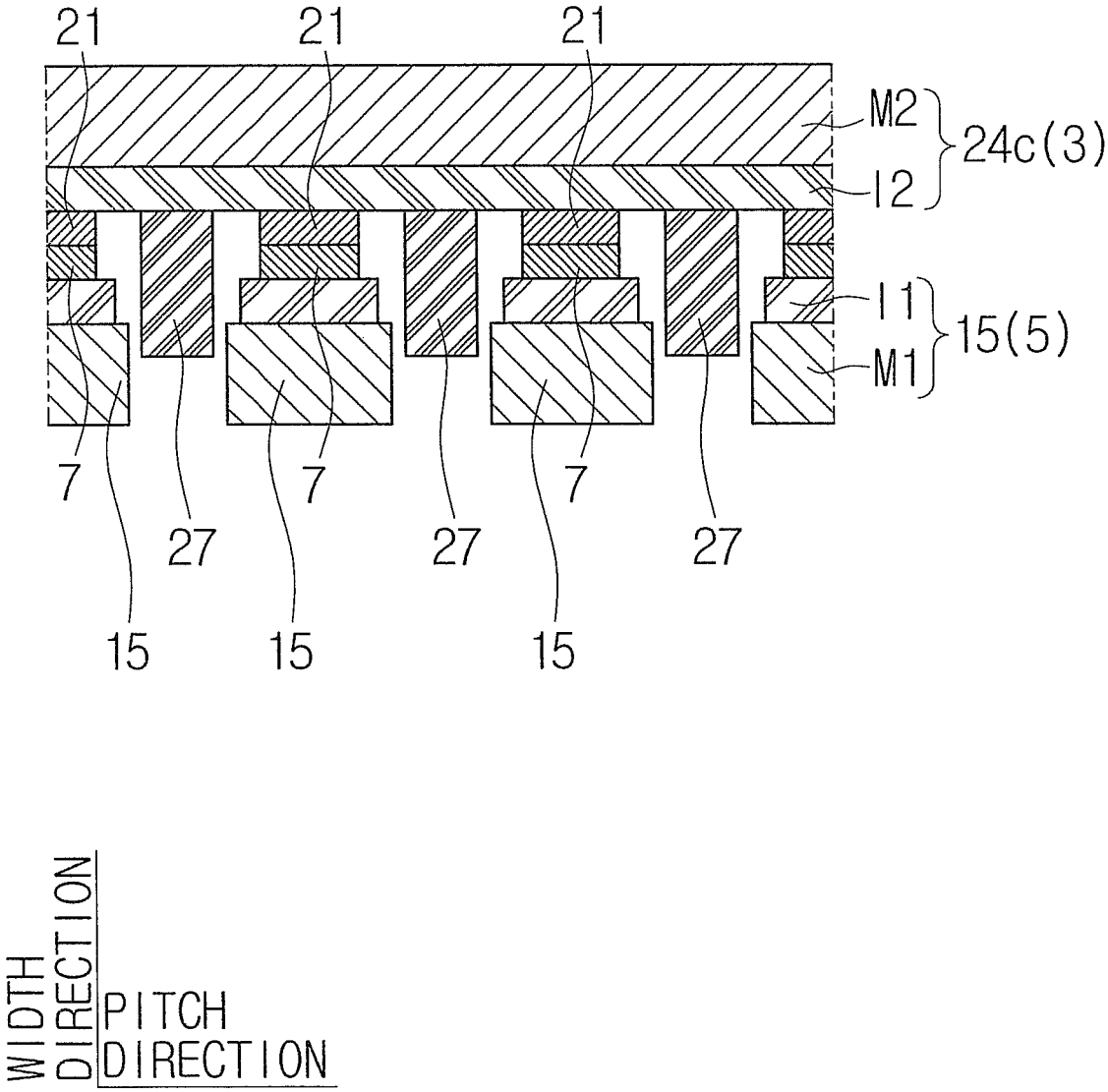
FIG. 12 is a horizontal section showing a contact state between a beam part of the receptacle connector and a beam contact part of the U-shaped part of the plug connector.
Figure 13:
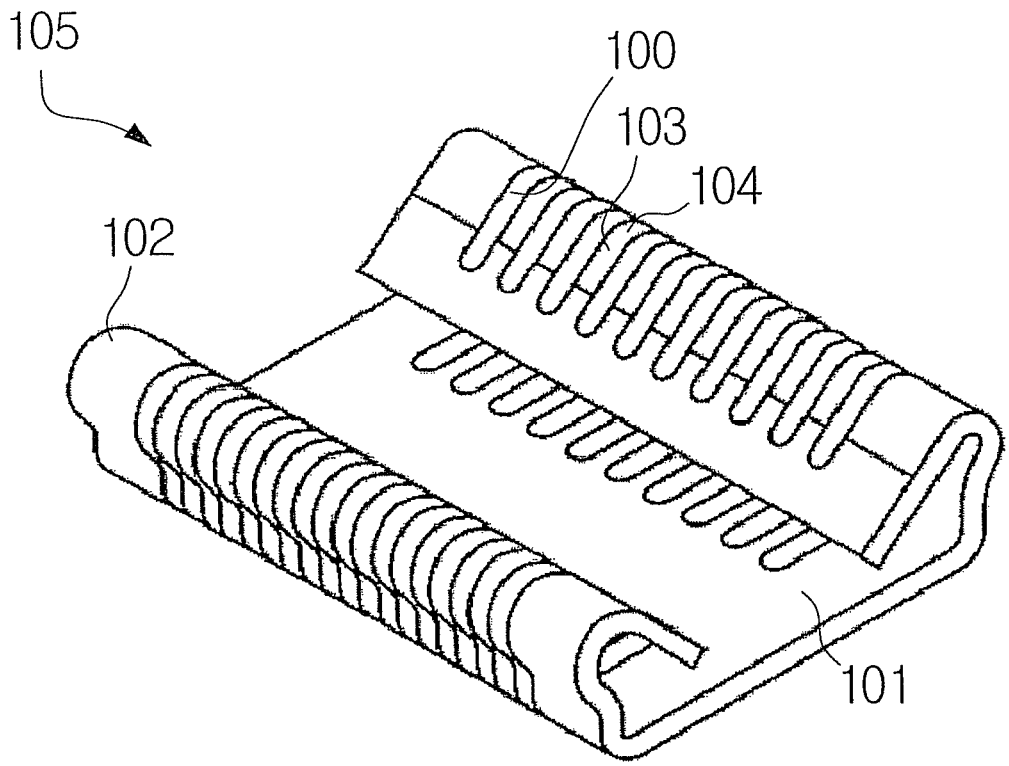
FIG. 13 is a diagram equivalent to FIG. 1 in Japanese Unexamined Patent Application Publication No. 2006-228612.

FIGS. 11 and 12 show the contact state of the conductive patterns 21 of the plug connector 3 shown in FIG. 8 and the conductive patterns 7 of the receptacle connector 5 shown in FIG. 4 is shown.

FIG. 11 is a horizontal section showing a face-to-face relationship between the surface part 14 of the receptacle connector 5 shown in FIG. 4 and the surface contact part 24*a* of the plug connector 3 shown in FIG. 8. As shown in FIG. 11, in a state where the surface part 14 of the receptacle connector 5 and the surface contact part 24*a* of the plug connector 3 face each other, each surface projection 26 formed on the surface contact part 24*a* of the plug connector 3 is inserted into each surface recess 17 formed in the surface part 14 of the receptacle connector 5. Accordingly, when the surface part 14 of the receptacle connector 5 and the surface contact part 24*a* of the plug connector 3 are placed in an appropriate relative positional relationship in the pitch direction even once, the relative positional relationship between the surface part 14 of the receptacle connector 5 and the surface contact part 24*a* of the plug connector 3 in the pitch direction will not substantially change. Therefore, the existence of the surface projections 26 and the surface recesses 17 improves contact reliability between the conductive patterns 21 of the plug connector 3 and the conductive patterns 7 of the receptacle connector 5.

FIG. 12 is a horizontal section showing a face-to-face relationship between the beam parts 15 of the receptacle connector 5 shown in FIG. 4 and the beam contact part 24*c* of the plug connector 3 shown in FIG. 8. As shown in FIG. 12, in a state where the beam parts 15 of the receptacle connector 5 and the beam contact part 24*c* of the plug connector 3 face each other, the beam projections 27 formed on the beam contact part 24*c* of the plug connector 3 are inserted between the adjacent beam parts 15 of the receptacle connector 5. Accordingly, when the beam parts 15 are placed in an appropriate position in the pitch direction on the beam contact part 24*c* of the plug connector 3 even once, the relative positional relationship between the beam parts 15 and the beam contact part 24*c* will not substantially change. The existence of the beam projections 27 enables the beam parts 15 to be aligned, thereby providing appropriate electrical contacts between the conductive patterns 21 and the conductive patterns 7.

The preferable exemplary embodiment of the present invention explained above has the following features.

(1) The board-to-board connector 1 (housingless connector) includes the receptacle connector 5 (first housingless connector part) and the plug connector 3 (second housingless connector part). The receptacle connector 5 includes the beam parts 15, which have the metal plate M1 (first metal plate) and the insulating layer I1 (first insulating layer) formed on the metal plate M1 (first metal plate), and the plurality of conductive patterns 7 (first conductive pattern) formed on the insulating layer I1 of the beam parts 15. The plug connector 3 includes the beam contact part 24*c*, that has the metal plate M2 (second metal plate) and the insulating layer I2 (second insulating layer) formed on the metal plate M2 (second metal plate) and the plurality of conductive patterns 21 (second conductive patterns) formed on the insulating layer I2 of the beam contact part 24*c*. The board-to-board connector 1 is configured in a way that the conductive patterns 7 and the conductive patterns 21 are electrically and respectively brought into contact by the mating of the receptacle connector 5 and the plug connector 3. Moreover, as shown in FIGS. 10 and 12, the beam projections 27, which are inserted between the adjacent beam parts 15 of the receptacle connector 5 at the time of mating the receptacle connector 5 and the plug connector 3, are formed between the adjacent conductive patterns 21 of the plug connector 3. In the above configuration, the beam parts 15 are aligned by the existence of the beam projections 27, and this therefore provides appropriate electrical contacts between the conductive patterns 21 and the conductive patterns 7.

(2) In addition, the alignment action of the beam parts 15 by the beam projections 27 is valuable especially when the beam parts 15 are formed in cantilevers.

(3) The receptacle connector 5 includes the surface part 14 that has the metal plate M1 and the insulating layer I1 formed on the metal plate M1 and the plurality of conductive patterns 7 formed on the insulating layer I1 of the surface part 14. The plug connector 3 includes the surface contact part 24*a* that has the metal plate M2 and the insulating layer I2 formed on the metal plate M2 and the plurality of conductive patterns 21 formed on the insulating layer I2 of the surface contact part 24*a*. Moreover, as shown in FIGS. 9 and 11, the surface projections 26, which are inserted between the adjacent conductive patterns 7 of the receptacle connector 5 at the time of mating the receptacle connector 5 and the plug connector 3, are formed between the adjacent conductive patterns 21 of the plug connector 3. In the above configuration, the existence of the surface projections 26 assures normal contacts between the conductive patterns 7 of the receptacle connector 5 and the conductive patterns 21 of the plug connector 3.

(4) Further, as shown in FIG. 5, the surface recesses 17 are formed where the metal plate M1 is directly exposed as the insulating layer I1 is not present between the adjacent conductive patterns 7 of the receptacle connector 5. As shown in FIG. 11, when the receptacle connector 5 is mated with the plug connector 3, the surface projections 26 are inserted into the surface recesses 17. In the above configuration, the existence of the surface projections 26 and the surface recesses 17 further assures normal contacts between the conductive patterns 7 of the receptacle connector 5 and the conductive patterns 21 of the plug connector 3.

(5) Furthermore, as shown in FIGS. 9 and 10, the tip part 27*a* (or the tip part 26*a*) in the substrate approaching direction (mating direction) of the beam projections 27 or the surface projections 26 are formed in a tapered shape. In the above configuration, when the plug connector 3 is mated with the receptacle connector 5, misalignment between the conductive patterns 7 of the receptacle connector 5 and the conductive patterns 21 of the plug connector 3 can be proactively eliminated.

(6) Additionally, the beam projections 27 or the surface projections 26 are formed of an insulator.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A housingless connector comprising:

a first housingless connector part including a plurality of beam parts and a plurality of first conductive patterns, the plurality of beam parts having a first metal plate and a first insulating layer formed on the first metal plate, and the plurality of first conductive patterns being formed on the first insulating layer of the plurality of beam parts; and a second housingless connector part including a beam contact part and a plurality of second conductive patterns, the beam contact part having a second metal plate and a second insulating layer formed on the second metal plate, and the plurality of second conductive patterns being formed on the second insulating layer of the beam contact part, wherein when the first housingless connector part and the second housingless connector part are mated, the plurality of first conductive patterns and the plurality of second conductive patterns are electrically and respectively brought into contact, and a beam projection is formed between the adjacent second conductive patterns of the second housingless connector part, and the beam projection is inserted between the adjacent beam parts of the first housingless connector part when the first housingless connector part and the second housingless connector part are mated.

2. The housingless connector according to claim 1, wherein the plurality of beam parts are formed in cantilevers.

3. A housingless connector comprising:

a first housingless connector part including a surface part and a plurality of first conductive patterns, the surface part having a first metal plate and a first insulating layer formed on the first metal plate, and the plurality of first conductive patterns being formed on the first insulating layer of the surface part;

a second housingless connector part including a surface contact part and a plurality of second conductive patterns, the surface contact part having a second metal plate and a second insulating layer formed on the second metal plate, and the plurality of second conductive patterns being formed on the second insulating layer of the surface contact part, wherein when the first housingless connector part and the second housingless connector part are mated, the plurality of first conductive patterns and the plurality of second conductive patterns are electrically and respectively brought into contact, and a surface projection is formed between the adjacent second conductive patterns of the second housingless connector part, and the surface projection is inserted between the adjacent first conductive patterns of the first housingless connector part when the first housingless connector part and the second housingless connector part are mated.

4. The housingless connector according to claim 3, wherein a surface recess is formed where the first metal plate is directly exposed as the first insulating layer is not present between the adjacent first conductive patterns of the first housingless connector part, and the surface projection is inserted into the surface recess when the first housingless connector part and the second housingless connector part are mated.

5. The housingless connector according to claim 1, wherein a tip part in a mating direction of the beam projection is formed in a tapered shape.

6. The housingless connector according to claim 3, wherein a tip part in a mating direction of the surface projection is formed in a tapered shape.

7. The housingless connector according to claim 1, wherein the beam projection is formed of an insulator.

8. The housingless connector according to claim 3, wherein the surface projection is formed of an insulator.

* * * * *

UNITED STATES PATENT AND TRADEMARK OFFICE

CERTIFICATE OF CORRECTION

PATENT NO. : 8,834,183 B2
APPLICATION NO. : 13/896036
DATED : September 16, 2014
INVENTOR(S) : Tetsuya Komoto et al.

It is certified that error appears in the above-identified patent and that said Letters Patent is hereby corrected as shown below:

On the Title Page,

Column 1, (72), replace "Inventors: "Tetsuya Komoto, Tokyo (JP); Yu Tatebe, Tokyo (JP); Takuya Yakahashi, Tokyo (JP); Ryuzo Shimeno, Tokyo (JP)" with --Inventors: Tetsuya Komoto, Tokyo (JP); Yu Tatebe, Tokyo (JP); Takuya Takahashi, Tokyo (JP); Ryuzo Shimeno, Tokyo (JP)--

Signed and Sealed this
Thirteenth Day of January, 2015

Michelle K. Lee

Michelle K. Lee
*Deputy Director of the United States Patent and Trademark Office*